US006361677B1

(12) United States Patent
Fritzinger et al.

(10) Patent No.: US 6,361,677 B1
(45) Date of Patent: Mar. 26, 2002

(54) PLANT AND PROCESS FOR THE ELECTROLYTIC DISSOLUTION BY OXIDATION OF A METAL

(75) Inventors: Bernard Fritzinger, Waldwisse; Marc Sardoy, Metz, both of (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/709,635

(22) Filed: Nov. 13, 2000

(30) Foreign Application Priority Data

Nov. 12, 1999 (FR) ..... 99 14186

(51) Int. Cl.[7] ..... C25D 3/30

(52) U.S. Cl. ..... 205/252; 205/300; 205/611; 205/704; 205/717; 204/227; 204/263; 204/275.1

(58) Field of Search ..... 205/252, 300, 205/611, 704, 717; 204/227, 263, 275.1

(56) References Cited

U.S. PATENT DOCUMENTS 6,120,673 A * 9/2000 Reiter et al. ..... 205/611

6,251,255 B1 * 6/2001 Copping et al. ..... 205/300

FOREIGN PATENT DOCUMENTS

| | | |
|---|---|---|
| EP | 0 398 735 | 11/1990 |
| EP | 0 770 708 | 5/1997 |
| GB | 1 226 658 | 3/1971 |

* cited by examiner

*Primary Examiner*—Arun S. Phasge
(74) *Attorney, Agent, or Firm*—Young & Thompson

(57) ABSTRACT

The plant comprises:

an electrolysis cell (1") having a soluble anode (2"1) and an insoluble cathode (3") without an interposed membrane, means for introducing the bath into the cell and for removing the bath from the cell, means for maintaining an appropriate bath density gradient in the said cell so that, if D1 is the density of the bath in the vicinity of the cathode and if D2 is the density of the bath in the vicinity of the anode, (D2–D1)>100 g/l.

Associated process. By virtue of the densitometric separation, the dissolved metal is not redeposited on the cathode and the overall dissolution yield is improved.

18 Claims, 4 Drawing Sheets

PLANT AND PROCESS FOR THE ELECTROLYTIC DISSOLUTION BY OXIDATION OF A METAL

The invention relates to a plant for the electrolytic dissolution by oxidation of a metal comprising:

an electrolysis cell having a soluble anode based on the said metal to be dissolved and an insoluble cathode without an interposed membrane, means for introducing, into the said cell, electrolyte bath to be enriched in ions of the said oxidized metal and means for removing, from the said cell, bath enriched in ions of the said oxidized metal, which means are suitable for keeping the said anode and the said cathode at least partially immersed in the said bath, means for circulating an electric current between the said soluble anode and the said cathode, so as to dissolve the metal of the said anode in the said bath.

The invention also relates to a process for the continuous production of a solution of a metal which comprises the stages consisting in:

introducing, into an electrodissolution cell having a soluble anode based on the said metal and an insoluble cathode without an interposed membrane, electrolyte bath to be enriched in ions of the said metal, so as to keep the said anode and the said cathode at least partially immersed, circulating an electrodissolution electric current between the said soluble anode and the said cathode, so as to dissolve the metal in the said bath by oxidation of the said anode, removing, from the electrodissolution cell, bath enriched in ions of the said metal constituting the solution of the said metal.

The applications of the plants and of the processes of the abovementioned type relate to metals which dissolve poorly chemically; an important application relates to the enriching in stannous ions ($Sn^{2+}$) of spent electrotinning solutions or the production of electrotinning solutions from virgin electrolyte.

The document EP 0 550 002 discloses a plant and a process of this type which are used to feed electrotinning solution to an electrodeposition cell having an insoluble anode and a material with a metal surface acting as cathode intended to be coated with tin; the electrodissolution cell of the plant for the production of electrotinning solution and the electrodeposition cell are connected in a closed loop or virtually closed loop, so that the enriched electrotinning solution is removed from the electrodissolution cell in order to be fed to the electrodeposition cell and so that, conversely, the electrotinning solution to be enriched is removed from the electrodeposition cell in order to be fed to the electrodissolution cell.

In order to avoid the disadvantages mentioned on page 2, lines 47 to 52 of this document, the electrodissolution plant does not comprise a membrane interposed between the soluble anode and the cathode.

According to the process disclosed in this document, as the electrodissolution plant does not comprise a membrane, when an electrodissolution electric current is circulated from the said soluble anode to the said cathode, a portion of the tin dissolved at the anode is deposited on the cathode, which is harmful to the overall dissolution yield of the plant for the production of electrotinning solution.

According to an essential characteristic of the electrodissolution process disclosed in this document, the rate of deposition of tin on the cathode is controlled at a level lower than the rate of dissolution of tin at the anode by reinforcing the reaction for the production of hydrogen on this cathode.

According to claim 8 of this document, one means for reinforcing the reaction for the production of hydrogen on this cathode consists in increasing the current density at this cathode, for example by decreasing the surface area of this cathode below that of the soluble anode.

According to this document, this plant and this process make it possible to enrich highly varied electrolyte baths, such as, for example, sulphuric acid baths, ferrostannate baths, methanesulphonate baths, cresol sulphonate baths, halide baths, fluosilicate baths and fluoborate baths.

As indicated on page 4, lines 46 to 50 of this document, it is preferable at the anode to maintain a current density below the critical current density at which oxygen begins to be formed, which makes it possible to prevent or at the very least to limit the formation of tin oxide (SnO) sludges.

As indicated on page 4, lines 50 to 52 of this document, the electrodissolution yield improves as the temperature of the bath increases and as the bath is stirred and homogeneous in composition.

An aim of the invention is to substantially improve the electrodeposition yields of the processes and plants of the abovementioned type.

To this end, a subject-matter of the invention is a plant for the electrolytic dissolution by oxidation of a metal comprising:

an electrolysis cell having a soluble anode based on the said metal to be dissolved and an insoluble cathode without an interposed membrane, means for introducing, into the said cell, electrolyte bath to be enriched in ions of the said oxidized metal and means for removing, from the said cell, bath enriched in ions of the said oxidized metal, which means are suitable for keeping the said anode and the said cathode at least partially immersed in the said bath, means for circulating an electric current between the said soluble anode and the said cathode, so as to dissolve the metal of the said anode in the said bath, characterized in that it comprises means for maintaining an appropriate bath density gradient in the said cell so that, if D1 is the density of the bath in the vicinity of the cathode and if D2 is the density of the bath in the vicinity of the most active part of the anode, $D2>D1$ and $(D2-D1)\geqq 100$ g/l.

These means for maintaining a bath density gradient should thus not comprise a membrane.

In the case where the temperature of the bath is approximately homogeneous in the cell, this density difference corresponds essentially to a difference in concentration of oxidized metal ions; preferably, if C1 is the concentration of ions of this metal in the vicinity of the cathode and if C2 is the concentration of ions of this metal in the vicinity of the most active part of the anode, $C1<<10{,}000\times C2$; preferably, C1 remains below the concentration threshold beyond which a deposit of the said metal is formed on the cathode.

"The most active part of the anodes" is defined as that combining the points of the anode where the current densities are highest and represent 90% of the current circulating between anode and cathode; this preciseness is important in the case where the anode is formed of granules of the said metal and where only a portion of the immersed granules contribute directly to the electrodissolution.

By virtue of the densitometric separation, the dissolved metal is not (or is only slightly) redeposited on the cathode and the overall dissolution yield is improved; the main advantage of the invention is that, as the concentration of the metal ions remains low in the vicinity of the cathode, the deposition of metal on the cathode is prevented or at least limited, which improves the overall electrodissolution yield of the plant.

The invention can also exhibit one or more of the following characteristics:

the means for maintaining the said density gradient comprise the positioning of the cathode in the bath at a level situated above the mean level of the most active part of the anode, the difference in level between that of the cathode and that of the most active part of the anode being adjusted in order to maintain the said density gradient.

In this configuration, the evolution of hydrogen does not disturb the bath region between the anode and the cathode, which facilitates the maintenance of the said density gradient.

the means for maintaining the said density gradient comprise means for maintaining an appropriate temperature gradient in the bath so that, if T1 is the temperature of the bath in the vicinity of the cathode and if T2 is the temperature of the bath in the vicinity of the most active part of the anode, T1>T2 and the difference (T1−T2) is adjusted in order to maintain the said density gradient; preferably, (T1−T2)>15° C.

The bath density gradient is thus reinforced by thermal means; preferably, these means comprise means for cooling the bath in the vicinity of the most active part of the anode.

the means for maintaining the said density gradient comprise:

- the appropriate positioning of the means for introducing bath to be enriched in order to introduce the bath into the said electrodissolution cell above the level of the cathode,
- the appropriate positioning of the means for removing enriched bath in order to remove the bath below the level of the most active part of the anode.

These positionings also contribute to the maintenance of the bath density gradient in the cell; the bath to be enriched can be "spent" bath weakly concentrated in oxidized metal and/or "fresh" bath not comprising oxidized metal.

the said cell comprises a cathode compartment separated from the remainder of the bath by a partition which passes through the surface of the bath and extends downwards to the level of the cathode.

The advantage is then that the evolution of hydrogen is channelled into this compartment and does not disturb the entire bath, which makes it possible to achieve the best maintenance of the density gradient.

the means for introducing bath to be enriched are appropriate for introducing, into the cathode compartment, "fresh" bath not comprising ions of the oxidized metal.

The term "fresh" bath not comprising ions of the oxidized metal" is understood to mean "virgin" electrolyte in which no addition of ions of the oxidized metal has been carried out.

As bath not comprising metal ions is then introduced in the vicinity of the cathode, the concentration of metal ions in the vicinity of the cathode is virtually zero, which decreases in proportion the deposition of metal on the cathode and improves the overall electrodissolution yield of the plant.

the said cell comprises at least one anode compartment separated from the remainder of the bath by a partition which passes through the surface of the bath and extends downwards until above the level of the most active part of the anode.

the means for introducing bath to be enriched are appropriate for introducing bath into the anode compartment.

In this configuration, the introduction of bath does not disturb the bath region between the anode and the cathode, which facilitates the maintenance of the said density gradient.

the said anode is formed essentially of granules of the said metal.

Advantages: ease of replacement, high contact surface area with the electrolyte, resulting in a fall in the current density, which decreases the risks of evolution of oxygen and of formation of sludges.

Another subject-matter of the invention is a process for the production of a solution of a metal comprising stages consisting in:

- introducing, into an electrodissolution cell having a soluble anode based on the said metal and an insoluble cathode without an interposed membrane, electrolyte bath to be enriched in ions of the said metal, so as to keep the said anode and the said cathode at least partially immersed,
- circulating an electrodissolution electric current between the said soluble anode and the said cathode, so as to dissolve the metal in the said bath by oxidation of the said anode,
- removing, from the electrodissolution cell, bath enriched in ions of the said metal constituting the solution of the said metal, characterized in that, during these stages, an appropriate density gradient is maintained in the bath so that, if D1 is the density of the bath in the vicinity of the cathode and if D2 is the density of the bath in the vicinity of the most active part of the anode, D2>D1 and (D2−D1)≧100 g/l.

The invention can also exhibit one or more of the following characteristics:

during these stages, an appropriate temperature gradient is maintained in the bath so that, if T1 is the temperature of the bath in the vicinity of the cathode and if T2 is the temperature of the bath in the vicinity of the most active part of the anode, T1>T2 and the difference (T1−T2) is adjusted in order to maintain the said density gradient; preferably, (T1−T2)>15° C.

in order to carry out the process,

- the bath to be enriched is introduced into the said electrodissolution cell above the level of the cathode,
- the enriched bath is removed below the level of the active part of the anode,
- and, the introduction and removal flow rates being approximately equal, in order to maintain an approximately constant bath level in the said cell, and defining the bath replacement flow rate,
- the said replacement flow rate is adjusted in order to maintain the said density gradient.

The difference between the concentration of metal ions in the enriched bath (exiting) and that in the bath to be enriched (entering) is then taken into account.

The said metal is based on tin.

The said bath is selected from the group consisting of baths based on alkanesulphonics, on arylsulphonic, on sulphonic acid or on sulphuric acid, halide baths, fluosilicate baths and fluoborate baths.

BRIEF DESCRIPTION OF THE DRAWINGS

The invention will be better understood on reading the description which will follow, given as non-limiting example, and with reference to the appended figures, in which.

The invention will be described, as non-limiting example, in the case of its application in the enriching in stannous ions ($Sn^{2+}$) of spent electrotinning solutions.

The plant for the electrolytic dissolution of tin comprises an electrolysis cell 1 having a soluble tin anode 2 and an insoluble cathode 3; no membrane is interposed between the anode 2 and the cathode 3; the cathode 3 is made of conductive material appropriately selected for withstanding the electrolyte and for exhibiting a hydrogen evolution overpotential which is as low as possible; a cathode made of stainless steel is conventionally taken here.

Figure 1:
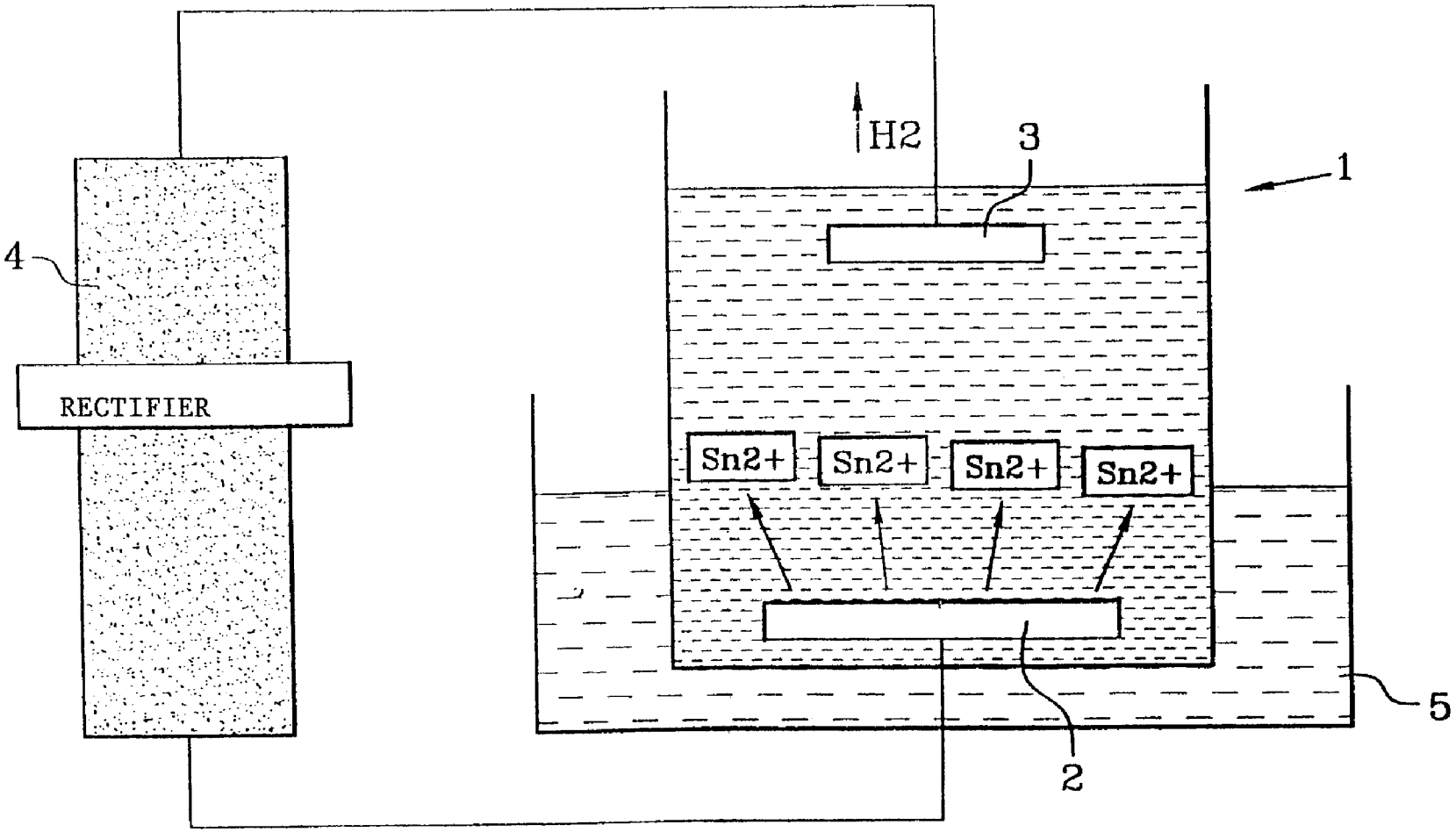
FIG. 1 is a functional diagram of an electrolytic dissolution plant according to the invention, without membrane and without stirring the electrolyte, where the cathode is positioned above the anode.

As indicated in FIG. 1, the cathode 3 is positioned in the cell above the anode 2.

Figure 2:
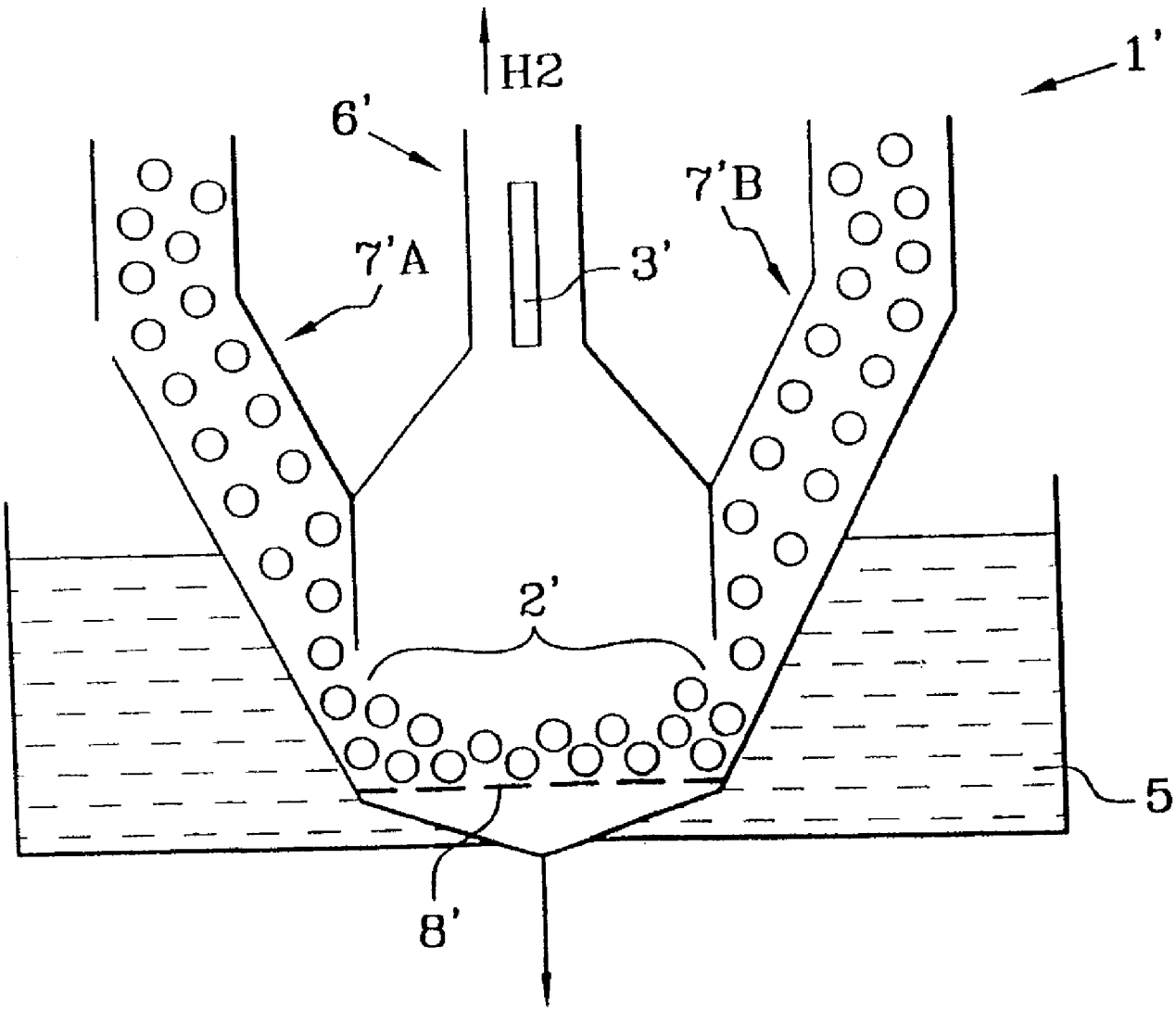
FIG. 2 represents a specific embodiment of an electrolytic dissolution plant according to the invention with two anode compartments and one central cathode compartment.
Figure 3:
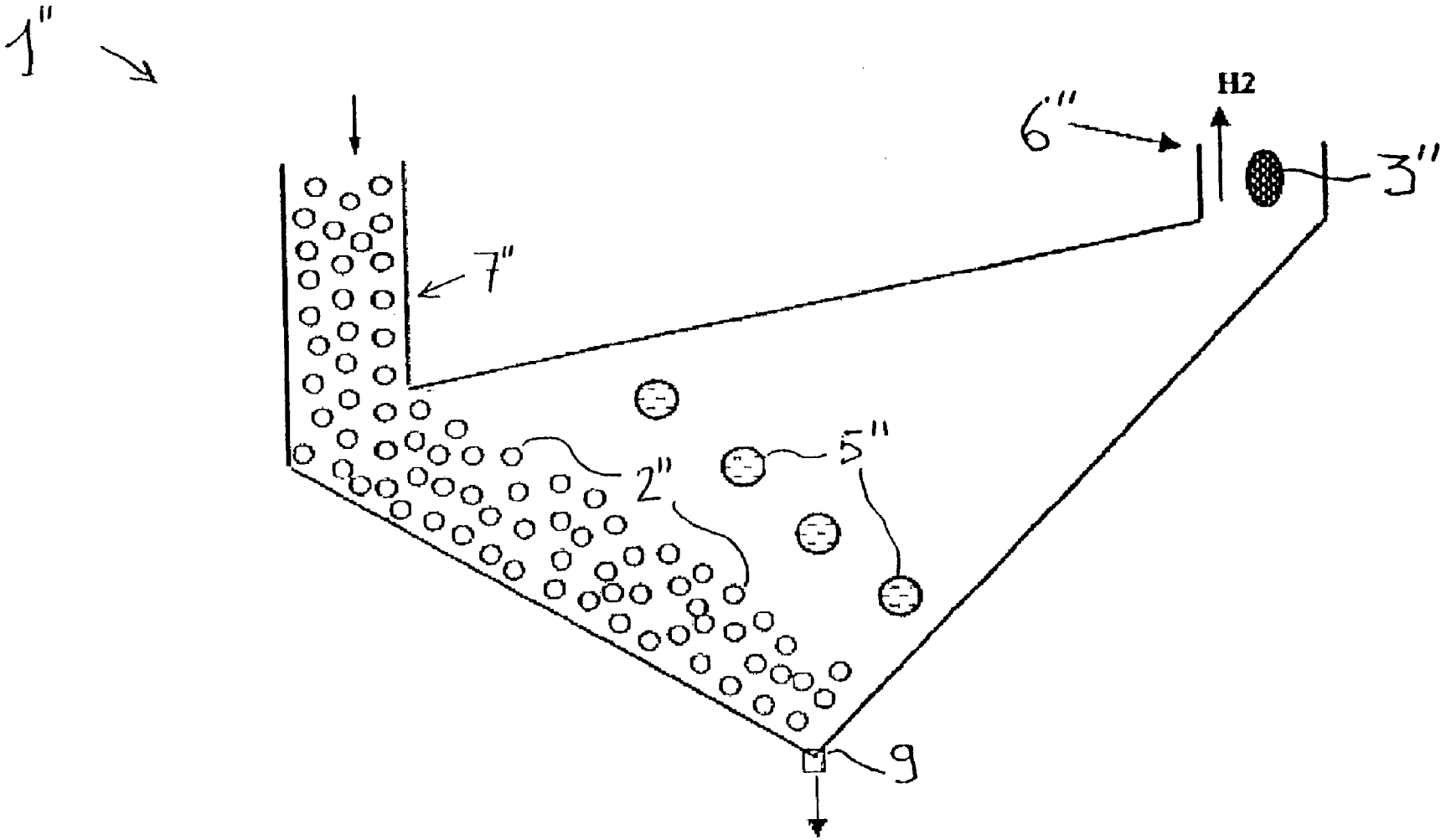
FIGS. 3 and 4 are respectively a diagram in transverse section and a perspective diagram of another embodiment of an electrolytic dissolution plant according to the invention with a lateral anode compartment and a cathode compartment on the opposite side.
Figure 4:
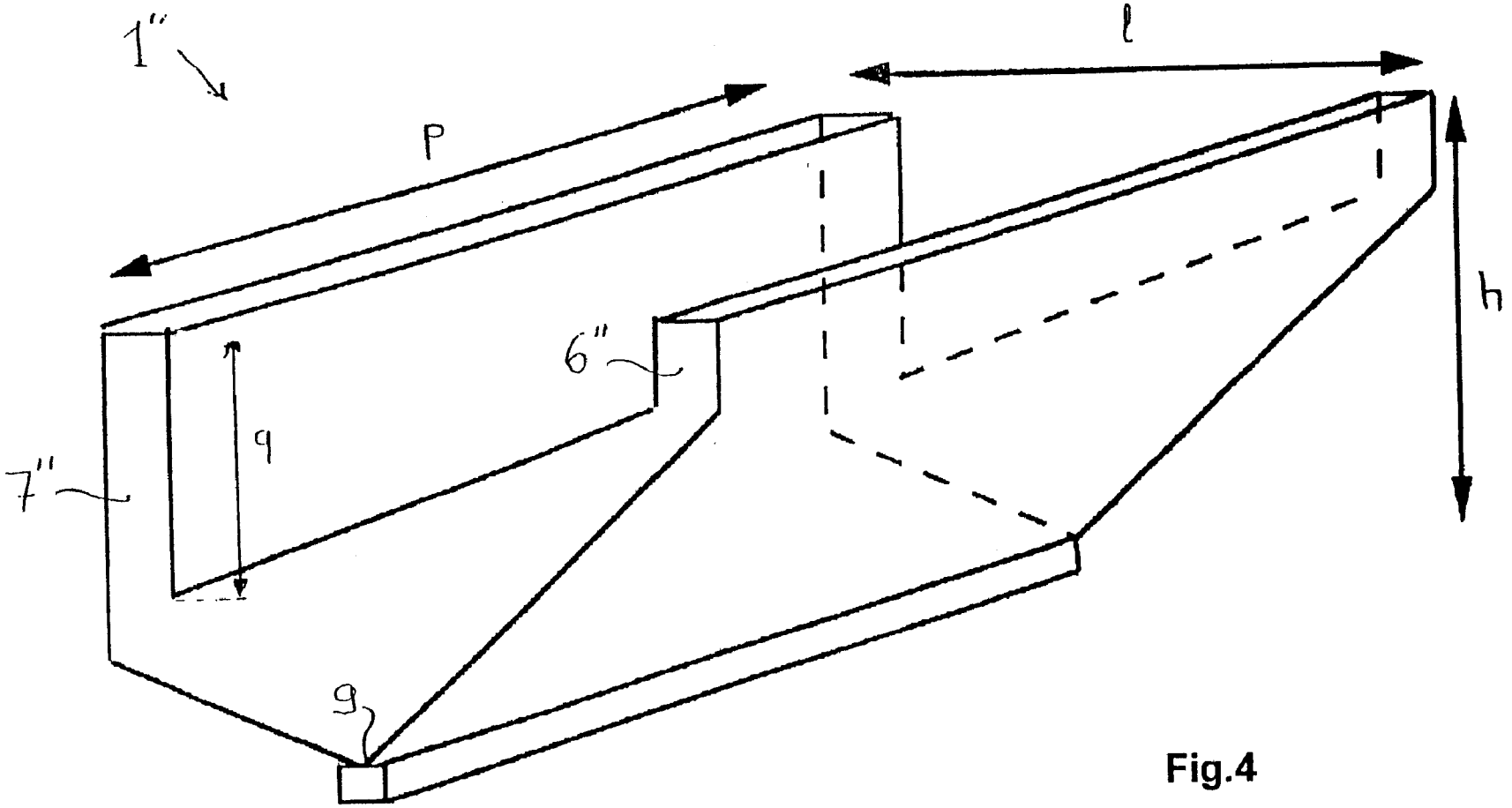

The plant comprises a pipe for removing enriched bath which emerges in the bottom of the cell at the level of or below the anode (not represented in FIG. 1); preferably, as illustrated in FIGS. 2 to 4, the bottom of the cell exhibits a conical shape which widens out upwards and which emerges downwards, at the tip of the cone, in the pipe for removing enriched bath.

The plant comprises at least one pipe for introducing bath to be enriched or virgin electrolyte which emerges in the cell at the level of or above the cathode (not represented in FIG. 1).

The plant comprises conventional means 4 for circulating a continuous electric current between the soluble anode 2 and the cathode 3 which are suitable for dissolving the tin of the anode 2 while preventing or else while limiting the evolution of oxygen.

The plant comprises means for adjusting the temperature of the cathode so as to limit the heating thereof.

The plant preferably comprises means 5 for cooling the bath in the vicinity of the anode to a temperature T2 which is lower than the temperature T1 of the bath in the vicinity of the cathode; in FIG. 1, these means correspond to a jacketed vessel comprising a cooling liquid, the bottom of the cell 1 being immersed in this vessel.

The implementation of the process according to the invention will now be described starting from an electrotinning bath to be enriched in $Sn^{2+}$ stannous ions.

Electrotinning bath to be enriched in stannous ions is introduced into the cell 1, via the bath introduction pipe, until the cathode 3 is immersed.

Using the means 4 for circulating an electric current, a continuous electric current is passed between anode 2 and cathode 3, so as to dissolve the tin of the anode while preventing evolution of oxygen at the anode; thus, it is advisable for the current density to remain, at any point in the anode, below the limit current density ($J_{lim.}$) beyond which, under the electrodissolution conditions, evolution of oxygen would begin; these electrodissolution conditions comprise in particular the concentration of $Sn^{2+}$, the temperature in the vicinity of the anode and the composition of the bath.

By maintaining the current density below ($J_{lim.}$), the following are prevented:

the evolution of oxygen, which would disturb the bath and would stir it to the point of preventing the formation of the density gradient specific to the invention, the formation of sludges by reaction of the nascent oxygen with the tin of the anode.

The passage of the current thus results in the formation of $Sn^{2+}$ ions in the vicinity of the anode and the release of hydrogen at the cathode.

Bath is then continuously removed in the vicinity of the anode via the bath removal pipe (see arrow pointing downwards starting from the cell bottom in FIGS. 2 and 3); because of the formation of the $Sn^{2+}$ ions, the bath removed is thus enriched in $Sn^{2+}$ ions so as to be suitable for use as electrolyte in a conventional electrotinning operation.

Electrotinning bath or virgin electrolyte to be enriched in stannous ions is continuously introduced into the cell, via the bath introduction pipe, at a flow rate corresponding approximately to that of the removal flow rate, so as to maintain the level of the bath constant in the cell 1.

Preferably, using the means for adjusting the temperature of the cathode and the means 5 for cooling the bath in the vicinity of the anode, an appropriate temperature gradient is maintained in the bath so that, if T1 is the temperature of the bath in the vicinity of the cathode and if T2 is the temperature of the bath in the vicinity of the most active part of the anode, T1>T2; preferably, T1−T2>15° C.

Thus, under continuous conditions, as the bath is not stirred in the cell, in contrast to the baths of the prior art as disclosed in EP 550 002, already cited, and as the cathode is positioned above the anode, as the bath depleted in $Sn^{2+}$ is introduced via the top of the cell while the bath enriched in $Sn^{2+}$ is removed via the bottom, the concentration of $Sn^{2+}$ ions remains higher at the level of the anode 2 than of the cathode 3 and the density of the bath remains higher at the level of the anode 2 than at the level of the cathode 3.

Advantageously, the temperature gradient further accentuates this density gradient, since the temperature of the bath is higher at the level of the cathode (T1) than of the anode (T2).

By way of indication, the concentration of $Sn^{2+}$ ions in the vicinity of the anode 2 can be as follows:

in a bath based on phenolsulphonic acid: 150 g/l;

in a bath based on methanesulphonic acid: 200 g/l;

in a bath based on sulphonic acid: 100 g/l.

According to the invention, the operating conditions for the cell, concerning in particular the vertical distance separating the anode from the cathode, the bath removal and introduction flow rates and the temperature gradient, are adjusted in a way known per se so that the concentration of $Sn^{2+}$ ions in the vicinity of the cathode 3 is at least 10,000 times lower than in the vicinity of the anode.

Thus, it is advisable for the concentration of $Sn^{2+}$ ions in the vicinity of the cathode to remain below $10^{-2}$ g/l, preferably of the order of $10^{-6}$ g/l.

As the concentration of the metal ions remains low in the vicinity of the cathode 3, the deposition of metal on the cathode is prevented or at least limited, which improves the overall electrodissolution yield of the metal.

Thus, the invention lies essentially in the establishment and the maintenance of a concentration gradient of metal ions between the cathode and the anode using in particular the following means, used alone or in combination:

positioning the cathode in the bath at a level situated above the level of the most active part of the anode; the vertical distance between these two levels must be adjusted in order to obtain the concentration gradient required under the operating conditions of the plant.

a maintenance and establishment of the temperature gradient (T1–T2) which is sufficient for the maintenance of the concentration gradient, taking into account the vertical distance between the anode and the cathode.

a removal of the enriched bath via the bottom of the cell and introduction of the bath to be enriched via the top of the cell; the replacement flow rate is then adjusted in order to maintain the concentration gradient above the minimum required value, taking into account the difference between the concentration of metal ions in the bath which is removed and that in the introduced bath (which can be virgin electrolyte).

According to a first alternative form of the invention, "fresh" bath not comprising $Sn^{2+}$ metal ions ("virgin electrolyte") and "spent" bath depleted in $Sn^{2+}$ ions are simultaneously introduced into the cell and two different bath introduction pipes are then provided, so as:

to introduce the "fresh" bath at the level of or above the cathode, as above, specifically in the immediate vicinity of the cathode 3, to introduce the "spent" bath at an intermediate level of the bath situated between the cathode and the anode; preferably, with regard to this intermediate level, a point remote from the cathode is chosen.

According to this first alternative form, as bath not comprising metal ions is introduced in the vicinity of the cathode, the concentration of metal ions in the vicinity of the cathode is even lower and virtually zero, which decreases in proportion the deposition of metal on the cathode and also improves the overall electrodissolution yield.

A second alternative form of the invention is illustrated in FIGS. 2 to 4:

the cell 1', 1" comprises a cathode compartment 6', 6" separated from the remainder of the bath by a partition which passes through the surface of the bath and extends downwards to the level of the cathode 3', 3"; by virtue of this arrangement, the evolution of hydrogen $H_2$ (see arrow upwards) is channelled into this compartment and does not disturb the density gradient in the active part of the bath in the cell.

the cell comprises at least one anode compartment 7'A, 7'B, 7" separated from the remainder of the bath by a partition which passes through the surface of the bath and extends downwards to above the level of the active part of the anode 2', 2"; by virtue of this arrangement, the bath to be enriched can be introduced via the anode compartment (arrow downwards at the inlet of the compartment 7" of FIG. 3) without disturbing the density gradient in the active part of the bath in the cell.

In the case where the cell comprises both a cathode compartment and an anode compartment and where both "fresh" bath not comprising $Sn^{2+}$ metal ions and "spent" bath depleted in $Sn^{2+}$ ions have to be introduced into the cell, the "fresh" bath is then introduced into the cathode compartment 6', 6" and the "spent" bath is then introduced into the anode compartment 7'A, 7'B, 7".

According to another alternative form of the invention, in the case where at least one anode compartment 7'A, 7'B, 7" is provided, tin granules are used for the anode 2', 2", as represented in FIGS. 2 and 3; during the dissolution, tin is then advantageously made up again by pouring the granules into the anode compartment; this form of anode made of granules introduces, in addition to the ease of replacement, a high contact surface area with electrolyte, which results in a fall in the current density and decreases the risks of evolution of oxygen and of formation of sludges.

According to this alternative form, the bottom of the cell is then equipped with a grid 8' for retaining the granules, in order to prevent them from being carried away in the bath which is removed.

The following examples illustrate the invention.

EXAMPLE 1

FIGS. 3 and 4 represent an electrodissolution cell used according to the invention for the dissolution of tin; the anode 2" is formed of tin granules; the cathode 3" is hollow, in order to allow circulation of cooling water; there is no diaphragm between the anode and the cathode.

The dimensions of the cell are (FIG. 4): height h=20 cm between the level of the surface of the bath and the cell bottom; width 1=30 cm, depth p =40 cm; in operation, the cell then comprises 8 liters of bath.

The cell exhibits a conical bottom, the tip of the cone 9 corresponding to the bath removal point; above the removal point is positioned a grid (not represented) with a suitable mesh for preventing the tin granules of the anode 2" from being carried away.

The cell comprises a lateral anode compartment 7", the partition of which extends downwards to q=12 cm below the surface of the bath.

The cell comprises an opposite lateral cathode compartment 6", the partition of which extends downwards to immediately below the level of the cathode 3".

The means for cooling the bath close to the active surface 2" of the anode are formed by pipes 5", cooled by circulation of cooling liquid, which pass through the bath.

The cell is operated under the following conditions:

nature and composition of the bath introduced into the cell: phenolsulphonic acid diluted twice;

bath replacement flow rate: 1.25 liters per hour;

intensity of the electrodissolution current: 80 A;

temperature of the bath at the level of the cathode: T1=70° C.

temperature of the bath at the level of the anode: T2=35° C.

no stirring of the bath.

It is then found that:

the concentration of stannous ions in the bath removed at 1.25 liters per hour is 125 g/l;

the electrodissolution yield is 100%.

If C"1 is the concentration of $Sn^{2+}$ ions in the vicinity of the cathode and if C"2 is the concentration of $Sn^{2+}$ ions in the vicinity of the most active part of the anode, it is advisable, in the absence of temperature difference (T1–T2), for C"1<<10,000×C"2, which makes it possible to prevent any deposition of tin on the cathode.

In the absence of temperature difference, if D"°1 is the density (g/l) of the bath in the vicinity of the cathode and if D"°2 is the density (g/l) of the stannous bath in the vicinity of the most active part of the anode, there would be:

D"°1=(concentration C"1, expressed in g/l,+density of the dilute phenolsulphonic acid: 1160 g/l)≈density of the dilute phenolsulphonic acid=1160 g/l;

this approximation is possible because, according to the invention, C"1 is very low.

D"°2=(concentration C"2, expressed in g/l,+density of the dilute phenolsulphonic acid: 1160 g/l).

The situation is therefore:

(D"°2−D"°1)≈(concentration C"2, expressed in g/l)=125 g/l.

In practice, the invention is applicable beyond (D"2−D"1) ≧approximately 100 g/l, whether the difference in density originates from the difference in concentration of $Sn^{2+}$ ions or, as is also the case here, from the difference in temperature (T1−T2).

Comparative Example 1

In order to illustrate the results of the invention, the same cell is operated under the same conditions as in Example 1, apart from the difference that the bath is vigorously stirred so as to maintain the same level of concentration of stannous ions and the same temperature level throughout the bath, in contrast to the invention.

The temperature of the bath at the level of the cathode is then identical to the temperature of the bath at the level of the anode: 50° C.

It is then found that:

the concentration of stannous ions in the bath removed at 1.25 liters per hour is only 15 g/l;

the overall electrodissolution yield is approximately 15%.

What is claimed is:

1. Plant for the electrolytic dissolution by oxidation of a metal comprising:

an electrolysis cell (1; 1'; 1") having a soluble anode (2; 2'; 2") based on the said metal to be dissolved and an insoluble cathode (3; 3'; 3") without an interposed membrane, means for introducing, into the said cell, electrolyte bath to be enriched in ions of the said oxidized metal and means for removing, from the said cell, bath enriched in ions of the said oxidized metal, which means are suitable for keeping the said anode and the said cathode at least partially immersed in the said bath, means for circulating an electric current between the said soluble anode and the said cathode, so as to dissolve the metal of the said anode in the said bath, characterized in that it comprises means for maintaining an appropriate bath density gradient in the said cell so that, if D1 is the density of the bath in the vicinity of the cathode and if D2 is the density of the bath in the vicinity of the most active part of the anode, D2>D1 and (D2−D1)≧100 g/l.

2. Plant according to claim 1, characterized in that the means for maintaining the said density gradient comprise the positioning of the cathode (3; 3'; 3") in the bath at a level situated above the mean level of the most active part of the anode (2; 21'; 2"), the difference in level between that of the cathode and that of the most active part of the anode being adjusted in order to maintain the said density gradient.

3. Plant according to claim 1, characterized in that the means for maintaining the said density gradient comprise means (5; 5") for maintaining an appropriate temperature gradient in the bath so that, if T1 is the temperature of the bath in the vicinity of the cathode and if T2 is the temperature of the bath in the vicinity of the most active part of the anode, T1>T2 and the difference (T1−T2) is adjusted in order to maintain the said density gradient.

4. Plant according to claim 3, characterized in that (T1−T2)>15° C.

5. Plant according to claim 1, characterized in that the means for maintaining the said density gradient comprise:

the appropriate positioning of the means for introducing bath to be enriched in order to introduce the bath into the said electrodissolution cell above the level of the cathode, the appropriate positioning of the means for removing enriched bath in order to remove the bath below the level of the most active part of the anode.

6. Plant according to claim 1, characterized in that the said cell comprises a cathode compartment (6'; 6") separated from the remainder of the bath by a partition which passes through the surface of the bath and extends downwards to the level of the cathode.

7. Plant according to claim 6, characterized in that the means for introducing bath to be enriched are appropriate for introducing, into the cathode compartment, "fresh" bath not comprising ions of the oxidized metal.

8. Plant according to claim 1, characterized in that the said cell comprises at least one anode compartment (7'A, 7'B; 7') separated from the remainder of the bath by a partition which passes through the surface of the bath and extends downwards until above the level of the most active part of the anode.

9. Plant according to claim 8, characterized in that the means for introducing bath to be enriched are appropriate for introducing bath into the anode compartment.

10. Plant according to claim 1, characterized in that the said anode (2'; 2") is formed essentially of granules of the said metal.

11. Plant according to claim 1, characterized in that the said cell comprises a cathode compartment (6'; 6") separated from the remainder of the bath by a partition which passes through the surface of the bath and extends downwards to the level of the cathode.

12. Plant according to claim 1, characterized in that the said cell comprises at least one anode compartment (7'A, 7'B; 7") separated from the remainder of the bath by a partition which passes through the surface of the bath and extends downwards until above the level of the most active part of the anode.

13. Process for the production of a solution of a metal comprising stages consisting in:

introducing, into an electrodissolution cell having a soluble anode (2; 2'; 2") based on the said metal and an insoluble cathode (3; 3'; 3") without an interposed membrane, electrolyte bath to be enriched in ions of the said metal, so as to keep the said anode and the said cathode at least partially immersed, circulating an electrodissolution electric current between the said soluble anode and the said cathode, so as to dissolve the metal in the said bath by oxidation of the said anode, removing, from the electrodissolution cell, bath enriched in ions of the said metal constituting the solution of the said metal, characterized in that, during these stages, an appropriate density gradient is maintained in the bath so that, if D1 is the density of the bath in the vicinity of the cathode and if D2 is the density of the bath in the vicinity of the most active part of the anode, D2>D1 and (D2−D1)≧100 g/l.

14. Process according to claim 13, characterized in that, during these stages, an appropriate temperature gradient is maintained in the bath so that, if T1 is the temperature of the bath in the vicinity of the cathode and if T2 is the temperature of the bath in the vicinity of the most active part of the anode, T1>T2 and the difference (T1–T2) is adjusted in order to maintain the said density gradient.

15. Process according to claim 14, characterized in that (T1–T2)>15° C.

16. Process according to any one of claims 13, characterized in that:

the bath to be enriched is introduced into the said electrodissolution cell above the level of the cathode, the enriched bath is removed below the level of the active part of the anode, and, the introduction and removal flow rates being approximately equal, in order to maintain an approximately constant bath level in the said cell, and defining the bath replacement flow rate, the said replacement flow rate is adjusted in order to maintain the said density gradient.

17. Process according to claims 13, characterized in that the said metal is based on tin.

18. Process according to claim 17, characterized in that the said bath is selected from the group consisting of baths based on alkanesulphonics, on arylsulphonic, on sulphonic acid or on sulphuric acid, halide baths, fluosilicate baths and fluoborate baths.

* * * * *